US009883979B2

(12) United States Patent
Cheng

(10) Patent No.: US 9,883,979 B2
(45) Date of Patent: Feb. 6, 2018

(54) SEAT BACK LINKING MECHANISM

(71) Applicant: MERITS HEALTH PRODUCTS CO., LTD., Taichung (TW)

(72) Inventor: Ming-Chuan Cheng, Taichung (TW)

(73) Assignee: Merits Health Products Co., Ltd., Taichung (TW)

( * ) Notice: Subject to any disclaimer, the term of this patent is extended or adjusted under 35 U.S.C. 154(b) by 168 days.

(21) Appl. No.: 14/806,288

(22) Filed: Jul. 22, 2015

(65) Prior Publication Data

US 2016/0022038 A1 Jan. 28, 2016

(30) Foreign Application Priority Data

Jul. 24, 2014 (TW) ..... 103125352 A

(51) Int. Cl.

| | |
|---|---|
| ***A47C 1/024*** | (2006.01) |
| ***A61G 5/12*** | (2006.01) |
| ***A61G 5/10*** | (2006.01) |
| *A61G 5/04* | (2013.01) |

(52) U.S. Cl.

CPC ..... *A61G 5/1067* (2013.01); *A47C 1/0244* (2013.01); *A61G 5/121* (2016.11); *A61G 5/122* (2016.11); *A61G 5/125* (2016.11); *A61G 5/128* (2016.11); *A61G 5/043* (2013.01); *A61G 2203/14* (2013.01)

(58) Field of Classification Search

CPC ..... A61G 5/1067; A61G 5/122; B60N 2/231; B60N 2/20; A47C 1/0244

See application file for complete search history.

(56) References Cited

U.S. PATENT DOCUMENTS

| | | | | |
|---|---|---|---|---|
| 5,549,357 | A * | 8/1996 | Counts | A61G 5/1067 280/304.1 |
| 6,129,415 | A * | 10/2000 | Galloway | A61G 5/1067 297/423.26 |
| 7,296,856 | B2 | 11/2007 | Rozaieski et al. | |
| 8,636,321 | B1 * | 1/2014 | Engman | A61G 5/1067 297/230.14 |
| 8,646,795 | B2 * | 2/2014 | Cerreto | A61G 5/1067 280/250.1 |
| 2007/0085396 | A1 * | 4/2007 | Hunziker | A61G 5/1067 297/330 |

FOREIGN PATENT DOCUMENTS

| | | |
|---|---|---|
| CN | 102078094 A | 6/2011 |
| JP | 2007209704 A | 8/2007 |

* cited by examiner

*Primary Examiner* — Timothy J Brindley

(74) *Attorney, Agent, or Firm* — Muncy, Geissler, Olds & Lowe, P.C.

(57) ABSTRACT

A seat back linking mechanism includes a base frame having a pivot portion; a back frame pivotally connected to the base frame; an actuation member slidably coupled to the back frame; a linkage having a first link and a second link pivotally coupled together, the first link and the second link being respectively pivotally coupled to the pivot portion of the base frame and the actuation member, and a driven slot; and a drag member having a drag pin adapted for dragging the driven slot of the linkage.

2 Claims, 9 Drawing Sheets

SEAT BACK LINKING MECHANISM

BACKGROUND OF THE INVENTION

1. Field of the Invention

The present invention relates to seat technology, and more particularly to a seat back linking mechanism that allows the seat back to be adjusted between a sitting posture and a reclining posture.

2. Description of the Related Art

U.S. Pat. No. 7,296,856 discloses a reclining seat with movable back support for wheelchair, which comprises a reclining seat assembly 10 comprising a back support translation mechanism 90 that comprises a first portion, namely, the support member 102 and a second portion 110, wherein the support member 102 is pivotally coupled to a back frame 60 and the second portion 110; the second portion 110 is pivotally coupled to a base 40. Adjustment of the reclining seat to a predetermined reclined angle is subject to sliding movement of the support member 102 along two followers 130 of two tracks 80 and the relative pivoting motion between the support member 102 and pivot components of the second portion 110.

The linking mechanism used in this prior art design of reclining seat is functional, however it has a complicated structure, not facilitating the deployment of the installation location and space allocation. Further, the actuation and stop stability of the linking mechanism are to be improved

SUMMARY OF THE INVENTION

The present invention has been accomplished under the circumstances in view. The technical concept of the present invention is to provide a seat back linking mechanism, which has the advantages of simple structure, accurate operation and high positioning stability and, facilitates space allocation.

To achieve this and other objects of the present invention, a seat back linking mechanism of the invention comprises a base frame comprising a pivot portion; a back frame pivotally connected to the base frame; an actuation member slidably coupled to the back frame; a linkage comprising a first link and a second link pivotally coupled together, the first link and the second link being respectively pivotally coupled to the pivot portion of the base frame and the actuation member, and a driven slot; and a drag member comprising a drag pin adapted for dragging the driven slot of the linkage.

By means of the operation of the first link and second link of the linkage to move the actuation member, the drag member can drive the first link and second link of the linkage to move the actuation member accurately. Further, the arrangement of the first link and second link of the linkage and the drag member facilitates space utilization, achieving the expected effects and objects of the present invention.

Other advantages and features of the present invention will be fully understood by reference to the following specification in conjunction with the accompanying drawings, in which like reference signs denote like components of structure.

DETAILED DESCRIPTION OF THE INVENTION

Figure 1:
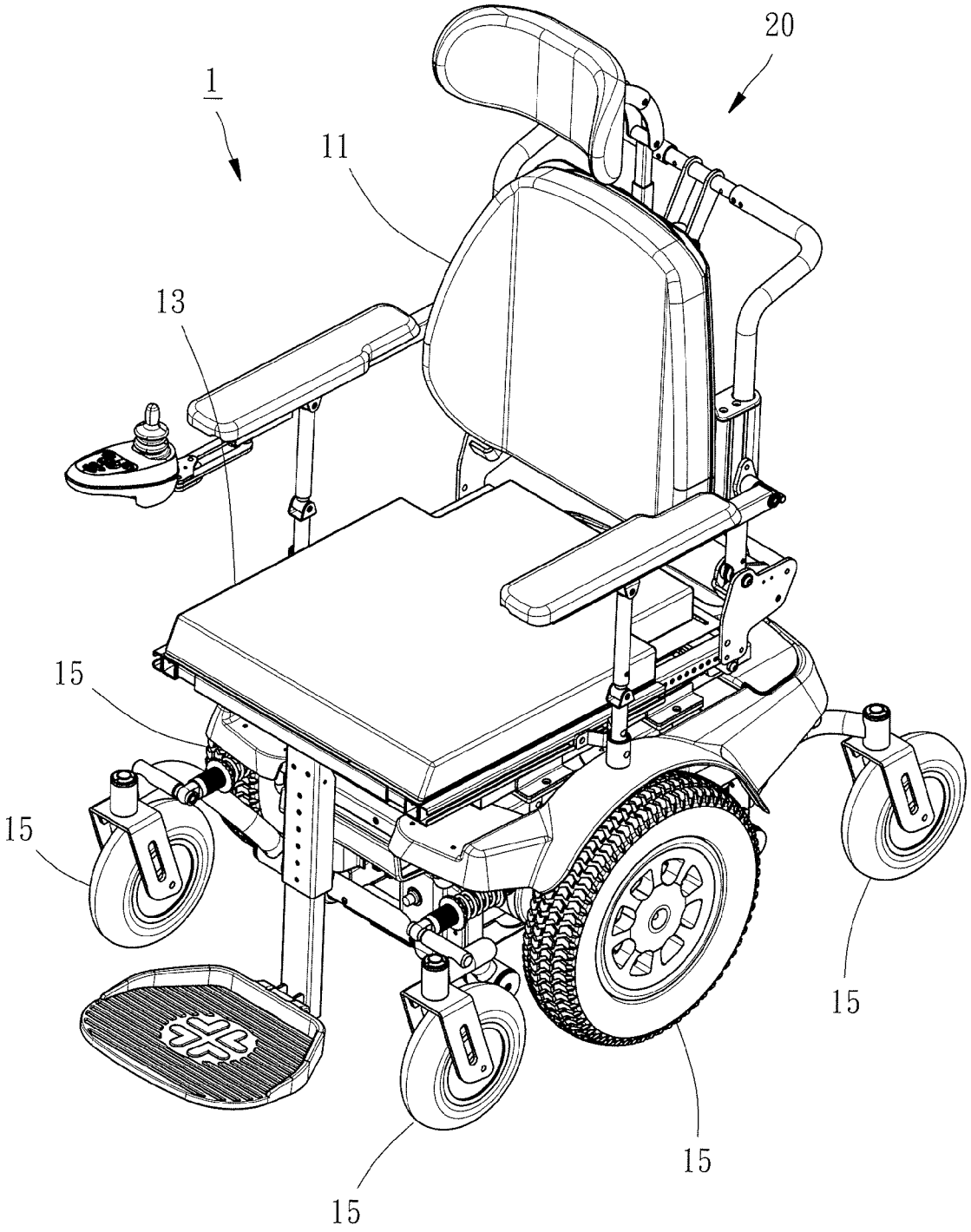
FIG. 1 is an oblique top elevational front view illustrating a seat back linking mechanism used in a wheelchair and set in a first status in accordance with the present invention.
Figure 2:
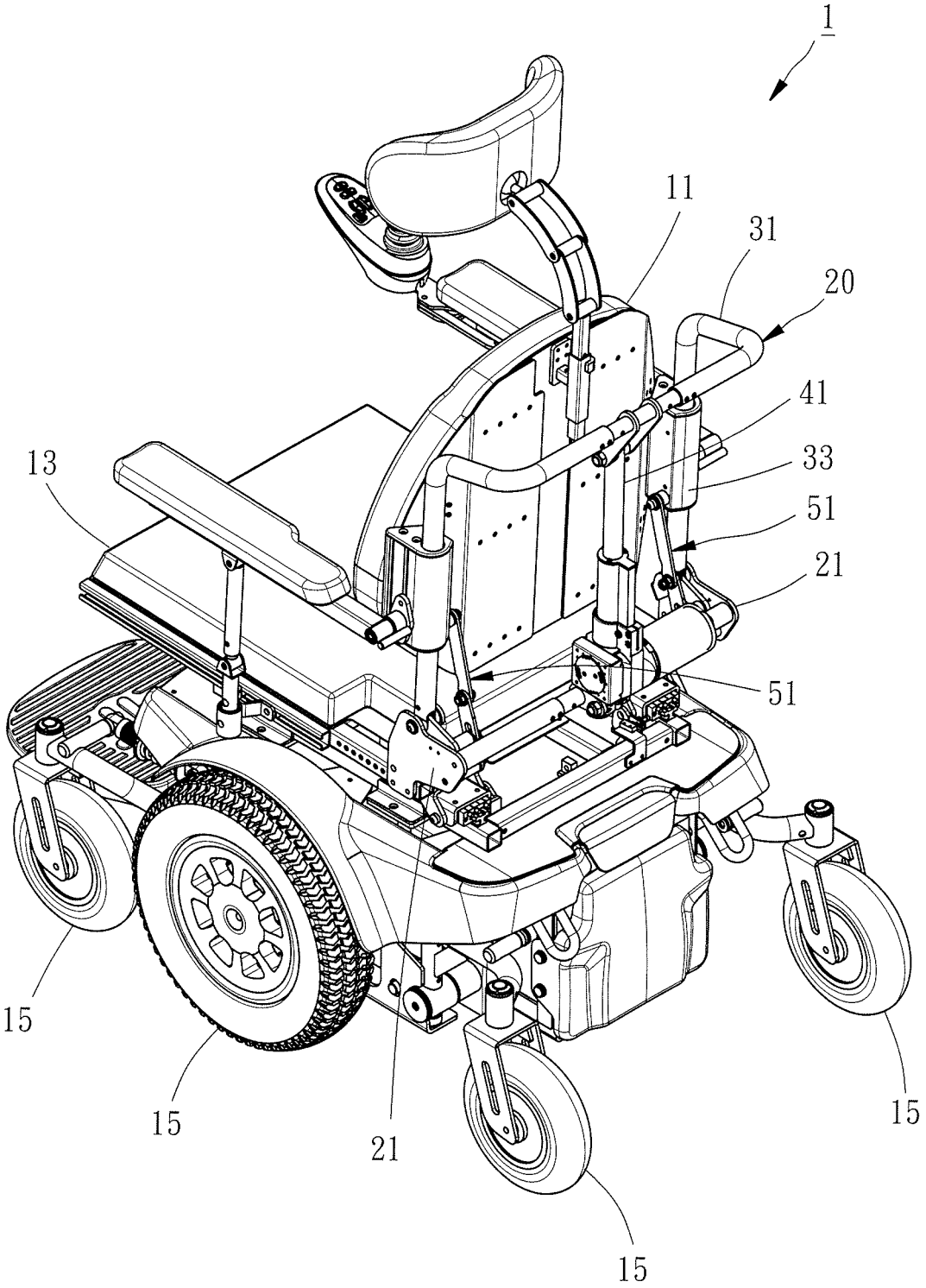
FIG. 2 is an oblique top elevational rear view of FIG. 1.
Figure 3:
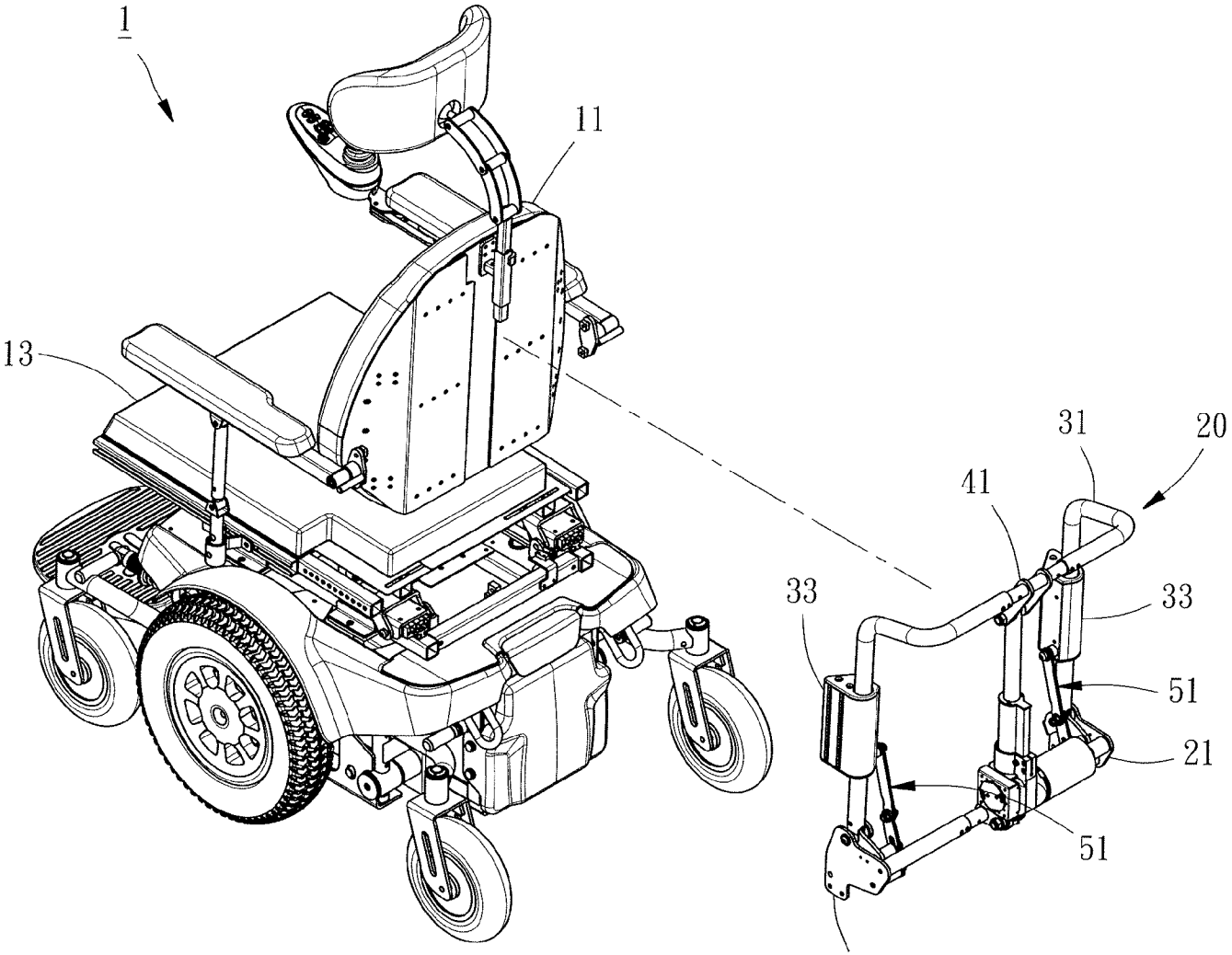
FIG. 3 is an explode view of FIG. 2.
Figure 4:
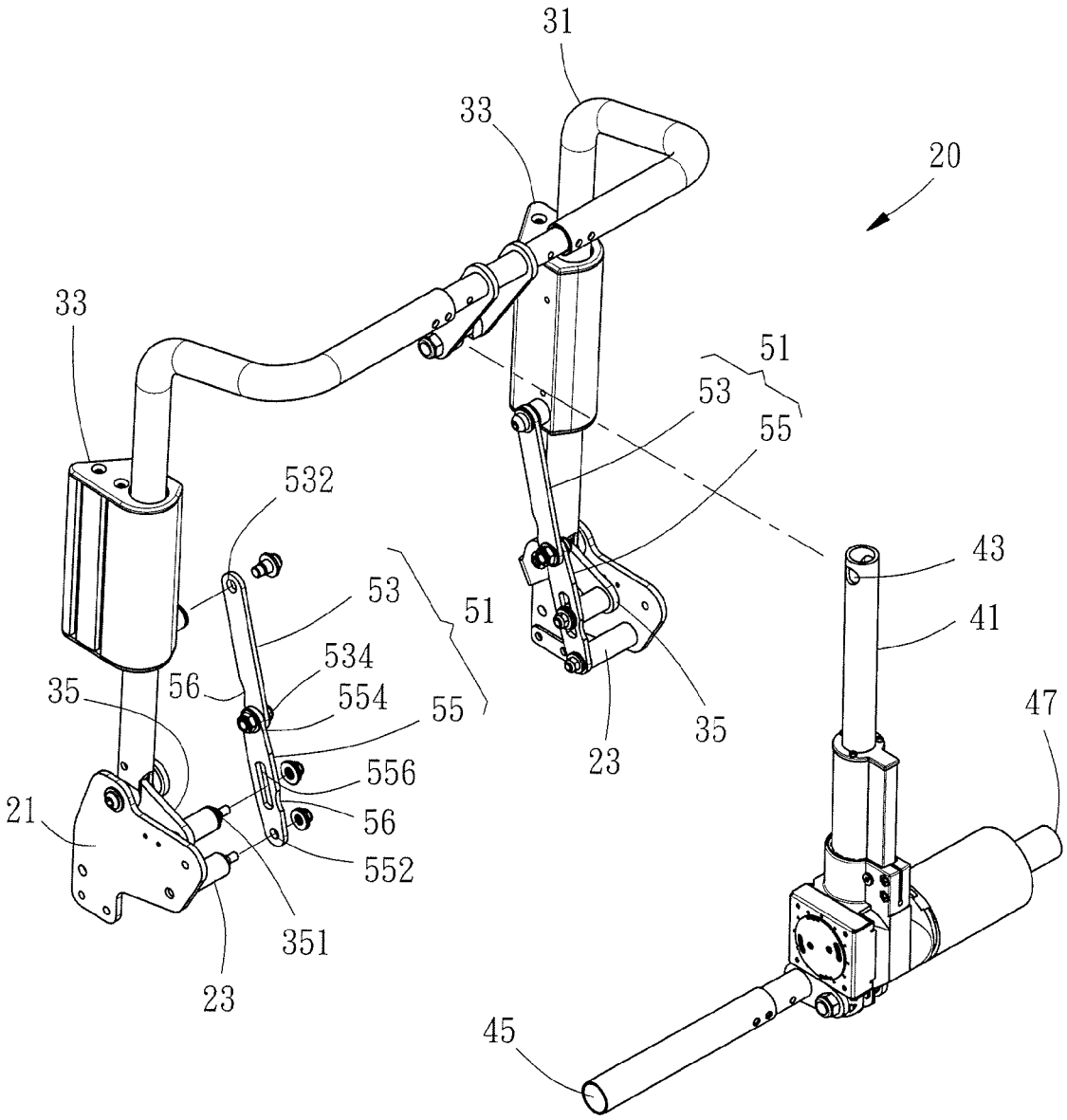
FIG. 4 is an exploded view of the seat back linking mechanism shown in FIG. 3.

Referring to FIGS. 1-4, a seat back linking mechanism 20 in accordance with the present invention is shown used in a wheelchair 1. The wheelchair 1 comprises a seat back 11, a seat 13 and at least two chair wheels 15. The seat back linking mechanism 20 is coupled between a back side of the seat back 11 of the wheelchair 1 and the seat 13 and disposed near the chair wheels 15.

The seat back linking mechanism 20 comprises:

two base frames 21 respectively pivotally coupled to respective outer edges of two opposite lateral sides of the seat 13 of the wheelchair 1, each comprising a pivot portion 23;

a back frame 31 mounted at the back side of the seat back 11 of the wheelchair 1, comprising two actuation members 33 respectively disposed adjacent to the two base frames 21;

two drag members 35 that are, in the present preferred embodiment, fixedly mounted at and swing-linked to the back frame 31, each comprising a drag pin 351, which is, in the present preferred embodiment, a guide rod where the guide rods of the two drag members are arranged in parallel or adapted for the mounting of rollers;

a driving device 41, which is, in the present preferred embodiment, a retractable rod assembly, comprising a first pivot connection portion 43 pivotally coupled with the back frame 31, a second pivot connection portion 45 pivotally coupled with the two base frames 21, and a third pivot connection portion 47;

two linkages 51 each comprising a first link 53, which comprises a first pivot portion 532 and a second pivot portion 534, and a second link 55, which comprises a first pivot portion 552, a second pivot portion 554 and a driven slot 556. In this embodiment, the driven slots 556 of the two second links 55 of the two linkages 51 are guide slots arranged in parallel. The actuation members 33 of the back frame 31 are respectively pivotally coupled to the first pivot portions 532 of the first links 53 of the linkages 51. The pivot portions 23 of the base frames 21 are respectively pivoted to the first pivot portions 552 of the second links 55 of the linkages 51. The drag members 35 are respectively pivoted to the driven slots 556 of the second links 55 of the linkages 51. The second pivot portions 534 of the first links 53 of the linkages 51 are respectively pivoted to the second pivot portions 554 of the second links 55 of the linkages 51.

The first link 53 of each linkage 51 comprises a stop portion 56. The second link 55 of each linkage 51 also comprises a stop portion 56. The stop portions 56 are adapted to provide a stop effect in a swinging action. Broadly speaking, the first link 53 or second link 55 of each linkage 51 comprises at least one stop portion 56.

Figure 5:
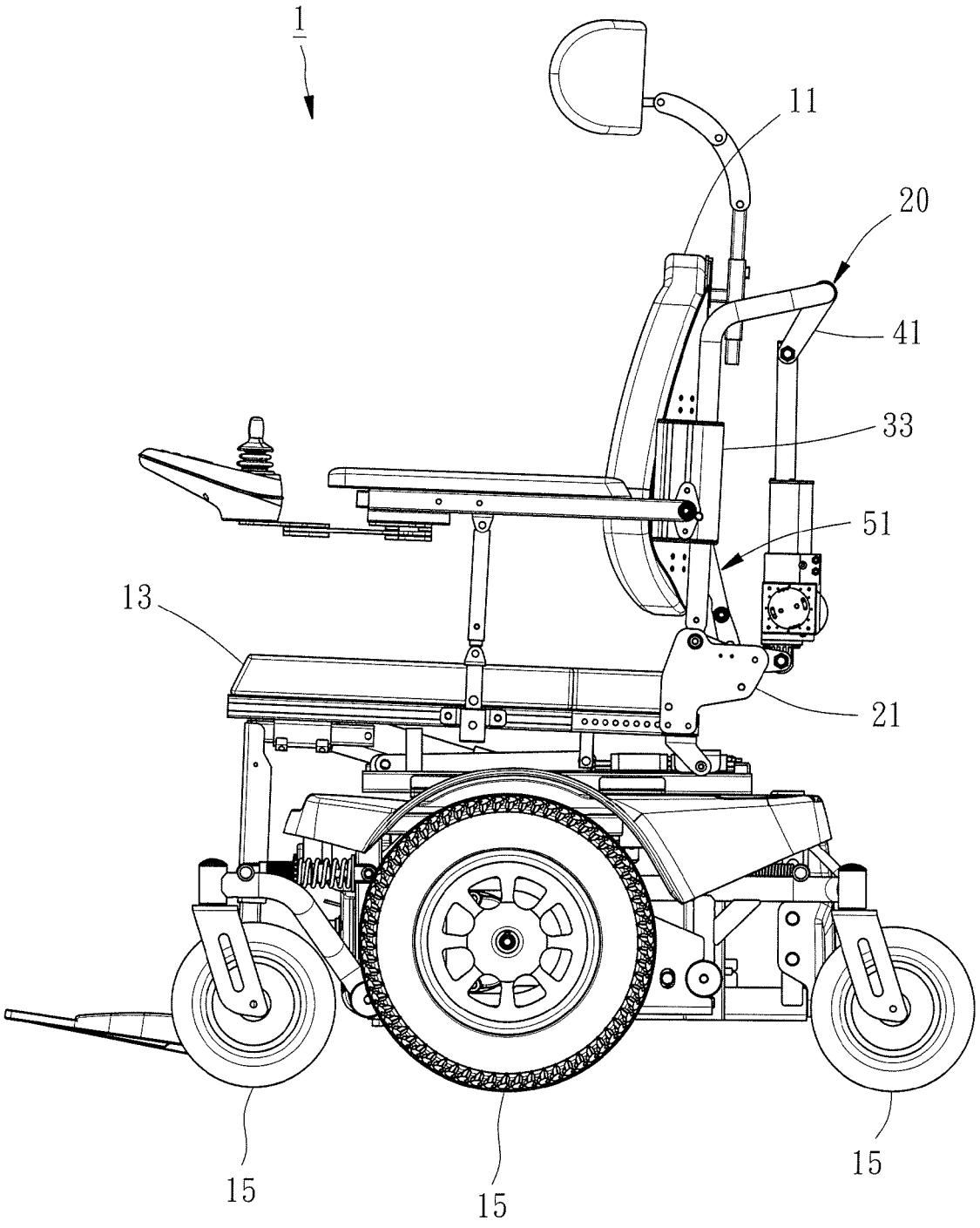
FIG. 5 is a schematic side view illustrating the seat back linking mechanism in the first status in the wheelchair in accordance with the present invention.
Figure 6:
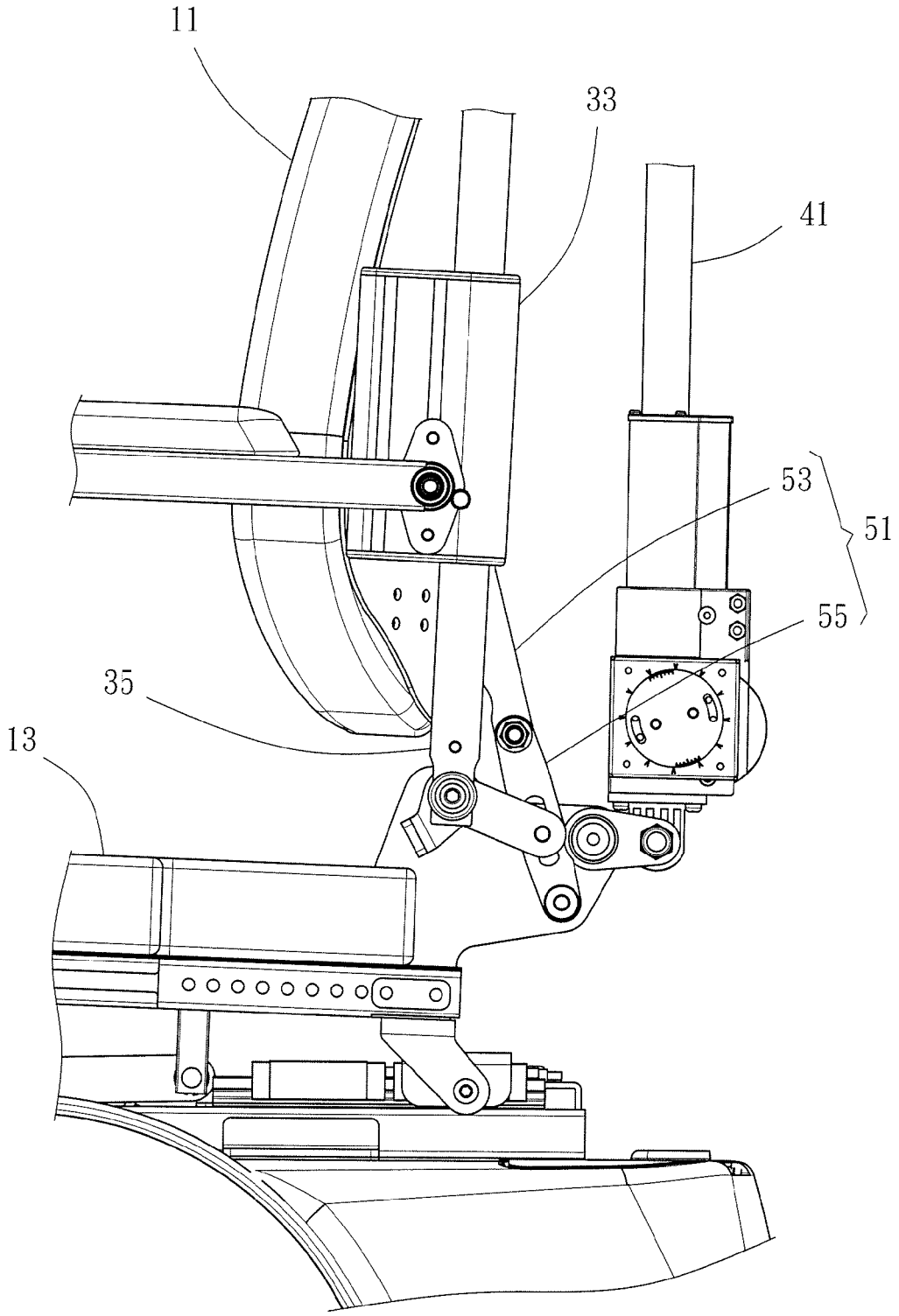
FIG. 6 is an enlarged view of a part of the seat back linking mechanism in the first status in accordance with the present invention.

After understanding of the structures of the component parts of the preferred embodiment of the present invention, the main features and effects of the present invention are outlined hereinafter:

Referring also to FIGS. 5 and 6 where the seat back linking mechanism 20 is shown in a first status. At first, when the base frames 21, back frame 31, driving device 41 and linkages 51 of the seat back linking mechanism 20 are moved relative one another to a first angle, the first links 53 of the linkages 51 are kept in a vertical status relative to the second links 55 of the linkages 51 due to the effect that the second pivot portions 534 of the first links 53 of the linkages 51 are respectively pivotally coupled to the second pivot portions 554 of the second links 55 of the linkages 51. Further, because the drag members 35 are respectively pivotally coupled with the driven slots 556 of the second links 55 of the linkages 51, moving the drag members 35 to a first position (not indicated by any reference sign) to bias the driving device 41 of the seat back linking mechanism 20 to the first angle can give a support to the actuation members 33 of the back frame 31 to hold the actuation members 33 in the first position, and thus the seat back can support the back of the user in a sitting position.

Figure 7:
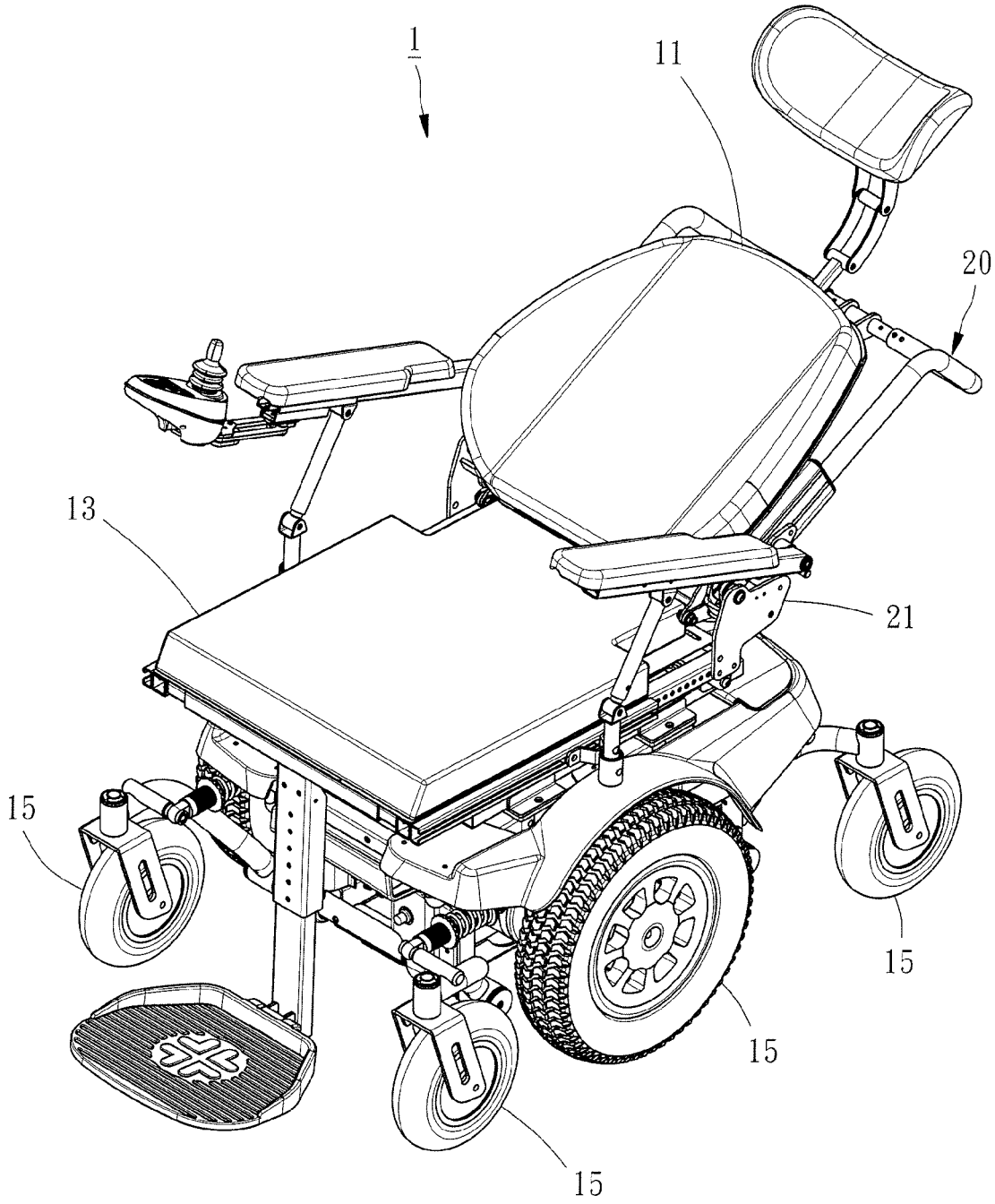
FIG. 7 is an oblique top elevational front view illustrating the seat back linking mechanism in a second status in the wheelchair in accordance with the present invention.
Figure 8:
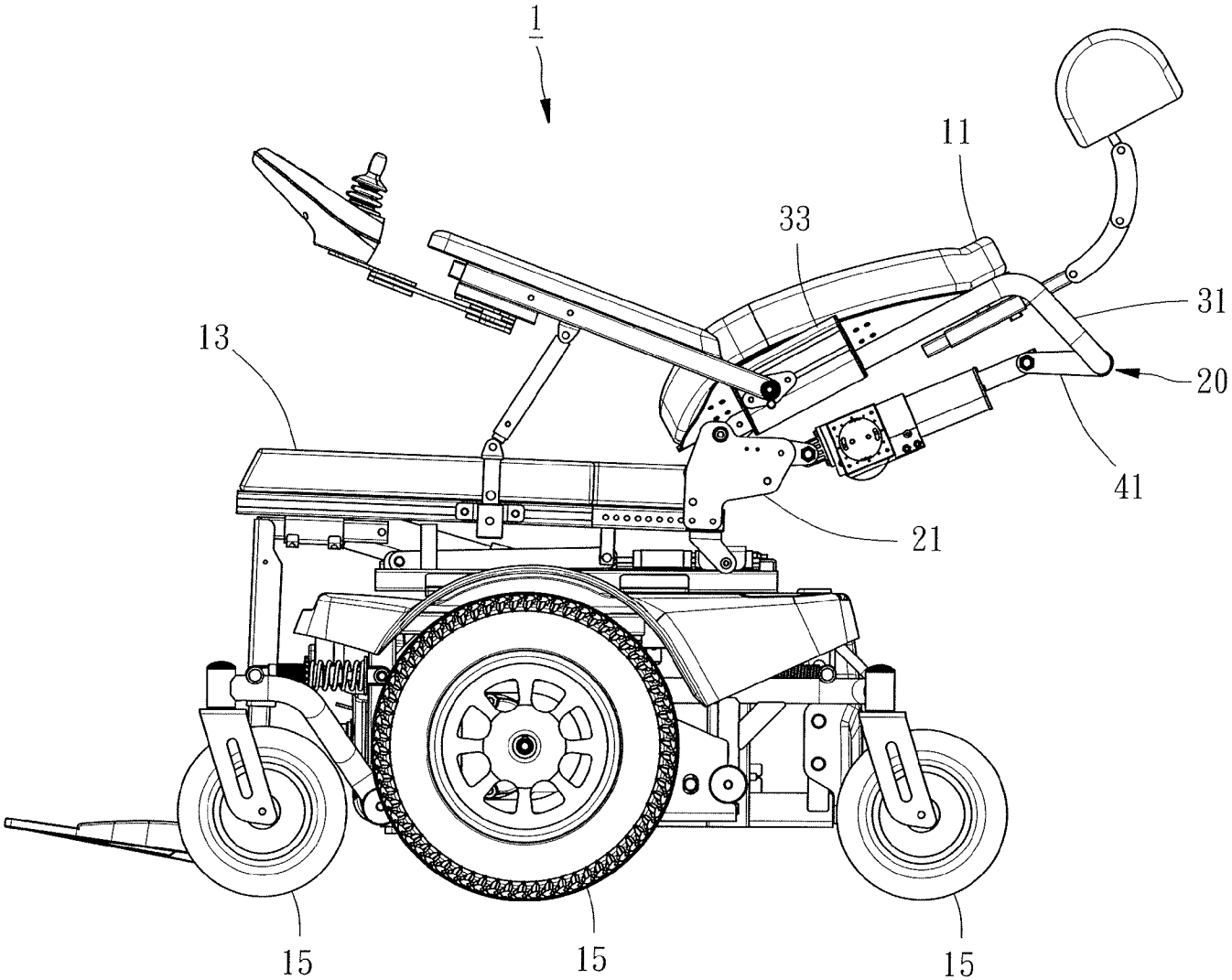
FIG. 8 is a schematic side view illustrating the seat back linking mechanism in the second status in the wheelchair in accordance with the present invention.
Figure 9:
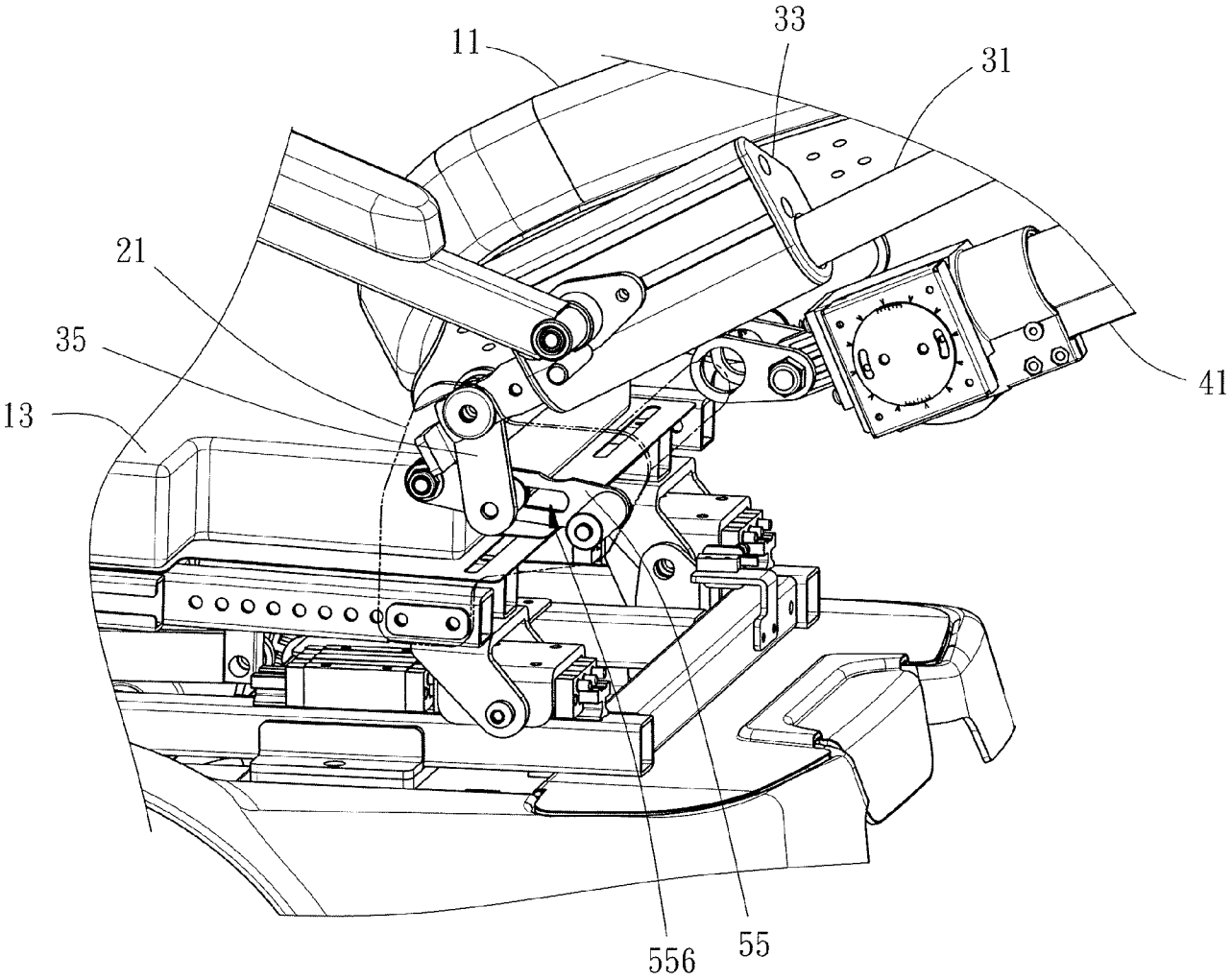
FIG. 9 is an enlarged view of a part of the seat back linking mechanism in the second status in accordance with the present invention.

Referring also to FIGS. 7-9 where the seat back linking mechanism 20 is shown in a second status. At first, when the base frames 21, back frame 31, driving device 41 and linkages 51 of the seat back linking mechanism 20 are moved relative one another to a second angle, the first links 53 of the linkages 51 and the second links 55 of the linkages 51 are received together due to the effect that the second pivot portions 534 of the first links 53 of the linkages 51 are respectively pivotally coupled to the second pivot portions 554 of the second links 55 of the linkages 51.

Further, because the drag members 35 are respectively pivotally coupled with the driven slots 556 of the second links 55 of the linkages 51, moving the drag members 35 to a second position (not indicated by any reference sign) to bias the driving device 41 of the seat back linking mechanism 20 to the second angle can give a support to the actuation members 33 of the back frame 31 to hold the actuation members 33 in the second position, and thus the seat back can support the back of the user in a reclined position.

Except the embodiment disclosed above, the invention can also be various embodied as follows:

For example, except the above-described design that the seat back linking mechanism 20 comprises two base frames 21, the seat back linking mechanism 20 can be defined comprising at least one base frame 21.

Further, except the above-described design that the back frame 31 of the seat back linking mechanism 20 comprises two actuation members 33, the back frame 31 can be defined comprising at least one actuation member 33.

Further, in the above-described design, the driving device 41 is pivotally coupled to the back side of the back frame 31 of the seat back linking mechanism 20. Alternatively, the driving device 41 can be pivotally coupled to the back side of the seat back 11 of the wheelchair 1.

Further, in the above-described design, the driving device 41 is pivotally coupled with the two base frames 21. Alternatively, the driving device 41 can be defined pivotally coupled to at least one of the base frames 21.

Further, in the above-described design, the seat back linking mechanism 20 comprises two linkages 51. Alternatively, the seat back linking mechanism 20 can be defined comprising at least one linkage 51.

Further, instead of the design of the drag members 35 for synchronous movement with the back frame 31, the drag members 35 can be made movable by the driving device 41 or other linking means.

Further, in the above-described design, the driven slot 556 of the second link 55 of each linkage 51 of the seat back linking mechanism 20 is a guide slot. Alternatively, the driven slot 556 can be a guide groove of a predetermined depth formed in the second link 55 and extending in direction from an outer end along the body thereof.

Further, the driven slots 556 of the linkages 51 are not limited to the design of guide slots; the drag pins 351 of the drag members 35 are not limited to the design of guide rods. The design of the driven slots 556 of the linkages 51 and the design of the drag pins 351 of the drag members 35 can be exchanged.

In conclusion, by means of the functioning of the first links 53 and second links 55 of the linkages 51 to move the actuation members 33 and the functioning of the drag members 35 to drag the first links 53 and second links 55 of the linkages 51, the actuation member 33 can be accurately moved; further, the arrangement of the first links 53 and second links 55 of the linkages 51 and the arrangement of the drag members 35 facilitate space utilization; the parallel arrangement of the drag pins 351 of the drag members 35 mates with the parallel arrangement of the driven slots 556 of the linkages 51, enhancing actuation stability and achieving the expected effects and objects of the present invention.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A seat back linking mechanism, comprising a base frame comprising a pivot portion;

a back frame pivotally coupled to said base frame;

an actuation member slidably coupled to said back frame;

a linkage comprising a first link, a second link and a driven slot, said first link being pivotally coupled to said second link, said first link and said second link being respectively pivotally coupled to the pivot portion of said base frame and said actuation member; and a drag member comprising a drag pin adapted for dragging the driven slot of said linkage;

wherein said drag member is fixedly mounted on said back frame and movable with said back frame;

wherein said driven slot of said linkage is formed at said second link;

wherein the driven slot of said linkage has two parallel sides.

2. The seat back linking mechanism as claimed in claim 1, further comprising a driving device adapted for driving said back frame to swing, said driving device being made in the form of a retractable rod assembly pivotally coupled with said base frame and said back frame.

* * * * *